US007992810B2

(12) United States Patent
Kellner et al.

(10) Patent No.: US 7,992,810 B2
(45) Date of Patent: Aug. 9, 2011

(54) FUEL INJECTOR WITH COUPLER

(75) Inventors: Andreas Kellner, Tamm (DE); Holger Rapp, Ditzingen (DE); Martin Katz, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 111 days.

(21) Appl. No.: 12/520,563

(22) PCT Filed: Dec. 28, 2007

(86) PCT No.: PCT/EP2007/064641

§ 371 (c)(1),
(2), (4) Date: Jun. 22, 2009

(87) PCT Pub. No.: WO2008/086941

PCT Pub. Date: Jul. 24, 2008

(65) Prior Publication Data

US 2010/0090032 A1 Apr. 15, 2010

(30) Foreign Application Priority Data

Jan. 16, 2007 (DE) ..... 10 2007 002 282

(51) Int. Cl.
*F02M 39/00* (2006.01)

(52) U.S. Cl. ..... 239/533.3; 239/96; 239/102.2; 239/124; 239/533.4; 239/585.1; 251/57

(58) Field of Classification Search ..... 239/124, 239/102.2, 533.3, 533.8, 533.9, 533.12, 585.1, 239/585.5, 96, 533.4; 251/57
See application file for complete search history.

(56) References Cited

U.S. PATENT DOCUMENTS

| | | | | |
|---|---|---|---|---|
| 5,697,554 | A | 12/1997 | Auwaerter et al. | |
| 6,457,699 | B1 * | 10/2002 | Stoecklein | 239/124 |
| 6,805,329 | B2 * | 10/2004 | Kegel | 239/102.2 |
| 2006/0186221 | A1 | 8/2006 | Heinz et al. | |
| 2008/0093483 | A1 | 4/2008 | Boecking | |

FOREIGN PATENT DOCUMENTS

| | | | |
|---|---|---|---|
| EP | 1693564 | A2 | 8/2006 |
| GB | 2296940 | A | 7/1996 |
| WO | 2006008200 | A1 | 1/2006 |

* cited by examiner

*Primary Examiner* — Steven J Ganey
(74) *Attorney, Agent, or Firm* — Ronald E. Greigg

(57) ABSTRACT

The invention relates to a fuel injector having a coupler. The reciprocating movement of an actuator is transmitted by the coupler to a pin-shaped injection valve member which is guided into the nozzle body. The coupler has a valve piston and a coupler sleeve, and the valve piston is displaced in the inner diameter area of the coupler sleeve. The inner diameter of the coupler sleeve is greater than the outer diameter of the injection valve member. The difference between the inner diameter of the coupler housing and the outer diameter of the injection valve member is 0.2 mm or less.

17 Claims, 2 Drawing Sheets

FUEL INJECTOR WITH COUPLER

CROSS-REFERENCE TO RELATED APPLICATION

This application is a 35 USC 371 application of PCT/EP 2007/064641 filed on Dec. 28, 2007.

BACKGROUND OF THE INVENTION

1. Field of the Invention

From German Patent Disclosure DE 196 50 865 A1, a magnet valve for controlling the fuel pressure in a control chamber of an injection valve, for instance for a common rail injection system, is known. By way of the fuel pressure in the control chamber, a reciprocating motion of a valve piston is controlled, with which an injection opening of the injection valve is opened or closed. The magnet valve includes an electromagnet, a movable armature, and a valve member, which is moved with the armature and is urged in the closing direction by a valve closing spring and cooperates with the valve seat of the magnet valve and thus controls the outflow of fuel from a control chamber.

2. Description of the Prior Art

In a currently used, leak-free fuel injector that is actuated by means of a magnet valve, the coupling between a valve piston and an injection valve member embodied in needle-like form is effected via a hydraulic coupler. The hydraulic coupler includes a coupler sleeve with an inner bore, in which the valve piston is guided. The diameter of the coupler sleeve is greater than the outside diameter of the injection valve member embodied in needle-like form. The coupler sleeve, on its lower end, rests with a sealing edge, embodied on its face end, on a nozzle body and thus encloses a coupler volume. In the state of repose, the coupler sleeve is positioned against an end face of the nozzle needle with a slight force, exerted by way of a spiral spring. The coupler sleeve or coupler is surrounded by fuel that is at system pressure. System pressure is understood to mean the fuel pressure level that is generated in a fuel injection system, for instance via a high-pressure pump, inside a high-pressure reservoir body (common rail).

If the fuel injector is triggered, then first the valve piston moves upward. This upward motion creates an underpressure in the coupler volume, compared to the system pressure level outside. Because of the underpressure, the injection valve member embodied in needle-like form follows the valve piston and as a consequence contacts the face end of the valve piston that is diametrically opposite the injection valve member which is preferably embodied in needle-like form. As the valve piston stroke becomes longer, the pressure in the coupler volume drops, since because of the pressure difference between the inner bore of the coupler sleeve and the outside diameter of the injection valve member embodied in needle-like form, the available fuel volume in the coupler increases. After the end of the triggering, the valve piston and the injection valve member embodied in needle-like form move downward again, in the closing direction. When the injection valve member embodied in needle-like form approaches its seat, the hydraulic force exerted from below on the injection valve member embodied in needle-like form drops, and the needle-like injection valve member leads ahead of the valve piston in the closing direction. Because of the fact that during the reciprocating motion fuel has flowed on into the coupler volume via the guidance play, the pressure in the coupler already reaches the system pressure before the valve piston is again in contact with the face end of the injection valve member embodied in needle-like form. Consequently, an overpressure comes about inside the coupler, causing the coupler sleeve to be lifted, counter to the slight prestressing force, from the face end of the nozzle body against which it is positioned, so that the trailing flow volume escapes again.

To avoid dynamic pressure differences between the coupler volume and the surrounding fuel, the coupler sleeve is guided on the valve piston with a comparatively great guidance play, on the order of magnitude of several micrometers, such as 8 μm, and over a length of several millimeters, such as 5 mm. The inside diameter of the coupler sleeve is approximately 3.8 mm, and the outside diameter of the injection valve member embodied in needle-like form is 3.5 mm. This layout causes the coupler pressure to trail the system pressure in the state of repose by the order of magnitude of 100 μs. By way of this play, during the reciprocating motion of the valve piston—as mentioned above—a quantity of fuel follows. Since after each injection the coupler sleeve lifts from its contact face on the nozzle body, after each injection this sleeve finds a slightly different position, and the shape of the guide gap (crescent gap-annular gap) varies from one injection even to another. Consequently, the quantity flowing into the coupler afterward during the reciprocating motion varies from one injection to another. These differences can become especially great whenever the following fuel quantity per injection is high, which is the case particularly with a long stroke of the injection valve member embodied in needle-like form and with high system pressure. Since the trailing fuel volume affects the closing motion and the closing instant of the injection valve member, this situation results in relatively major variations in the injection quantity from stroke to stroke.

SUMMARY AND ADVANTAGES OF THE INVENTION

According to the invention, a leak-free fuel injector is proposed, which is actuatable by means of an actuator, such as a magnet valve, and in which the difference in diameter between the inside diameter of the coupler sleeve and the outside diameter of the injection valve member that is preferably embodied in needle-like form is no more than 0.2 mm. Because of this reduction in the difference in diameter between the outside diameter of the injection valve member that is preferably embodied in needle-like form and the inside diameter of the coupler chamber sleeve surrounding it, the pressure drop in the coupler during the reciprocating motion is reduced. If the difference in diameter between the inside diameter of the coupler sleeve and the outside diameter of the injection valve member embodied in needle-like form is 0, then a pressure difference occurs only during the lifting of the injection valve member, preferably embodied in needle-like form, out of the nozzle seat and becomes 0 again as soon as the injection valve member embodied in needle-like form has left the region of the seat throttle restriction. A slight diameter difference, however, is necessary in order to attain a hydraulically prestressed spring for the sake of hydraulic coupling between the valve piston and the injection valve member.

It is also advantageous if the guidance play between the coupler sleeve surrounding the injection valve member and the valve piston guided in it is reduced, in particular to a value of several micrometers, such as values of less than 5 μm. Because of the circumstance that the trailing volumetric flow is proportional to the pressure difference along the guidance length but is inversely proportional to the third power of the guidance play, this provision is extremely effective in terms of the trailing flow of fuel into the coupler. Finally, the guidance length between the coupler sleeve, surrounding the injection valve member that is preferably embodied in needle form, and the injection valve member embodied in needle-like form itself can optionally be increased to values of more than 5 mm. Since with increasing coupler volume in the state of repose, the time lag until the opening of the injection valve member embodied in needle-like form increases more and more, the coupler volume in the state of repose remains limited to values<40 $mm^3$.

The trailing flow of fuel into the coupler is maximally reduced during the injection event by the embodiment proposed according to the invention. The fuel volume contained in the coupler, and the idle volume present there, are kept small without the trailing fuel flow, in order to attain the most direct possible coupling of the valve needle to the valve piston. Because the surroundings of the coupler are surrounded by system pressure, the fuel injector is embodied as leak-free.

BRIEF DESCRIPTION OF THE DRAWINGS

The invention will be described in further detail below in conjunction with the drawings, in which.

DESCRIPTION OF THE PREFERRED EMBODIMENTS

Figure 1:
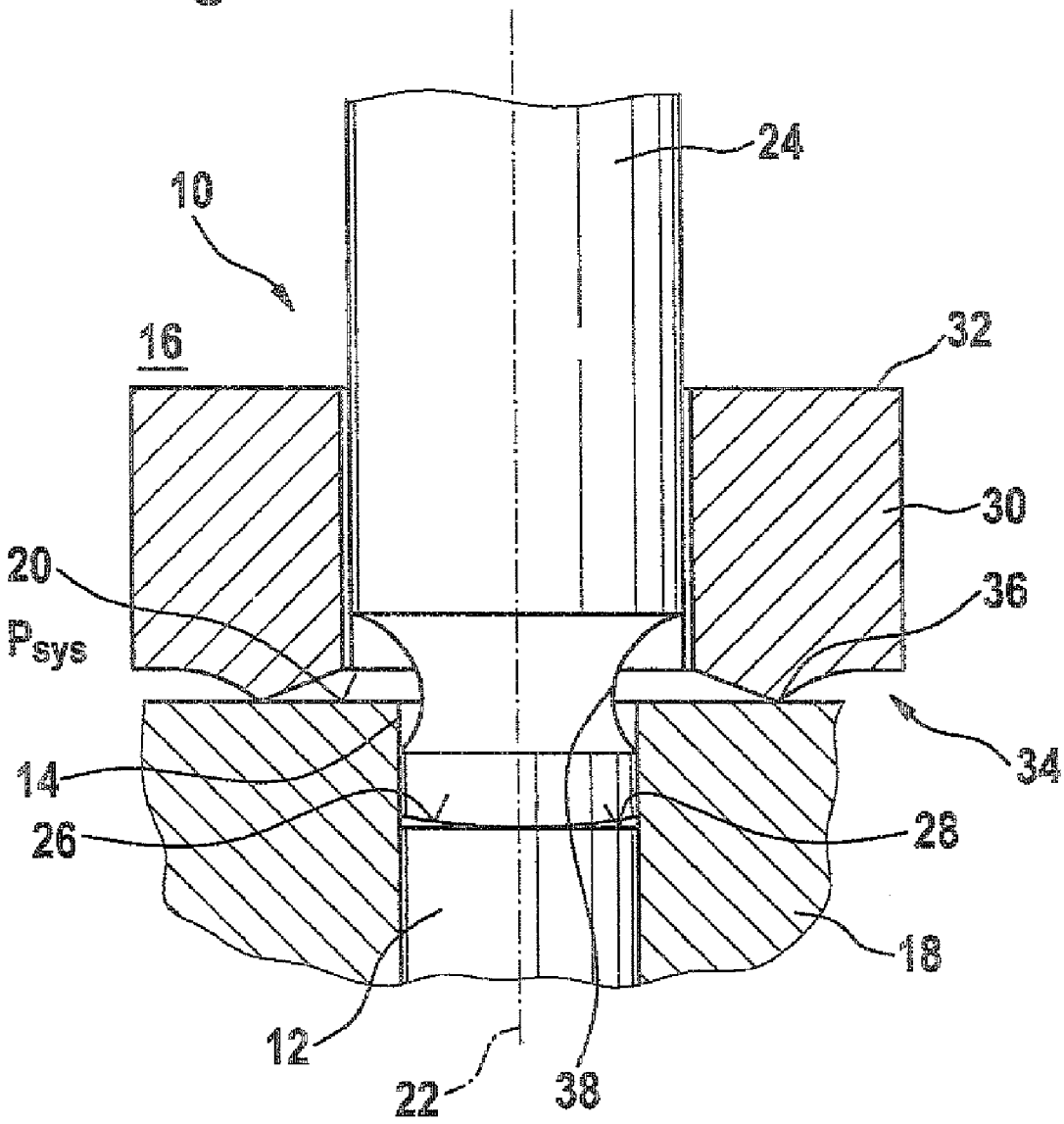
FIG. 1 shows a fuel injector from the prior art, with coupling between the valve piston of a coupler and an injection valve member embodied in needle-like form.

From FIG. 1, an embodiment of a coupler for a fuel injector in accordance with the prior art can be seen.

From FIG. 1, it can be seen that a fuel injector 10 includes an injection valve member 12, embodied in particular in needle-like form. The injection valve member embodied in needle-like form 12 is guided in a bore 14 of a nozzle body 18. The fuel injector 10 includes a hollow chamber 16, in which system pressure $P_{sys}$ prevails. The system pressure $P_{sys}$ is equivalent to a pressure level that is generated in a reservoir body (common rail), for instance by a high-pressure supply unit. The nozzle body 18 includes the bore 14, in which the injection valve member 12, embodied in particular in needle-like form, is guided and which has a face end 20. One axis of the injection valve member 12 that is embodied in particular in needle-like form is identified by reference numeral 22 and extends coaxially to the axis of a valve piston 24. The valve piston 24 includes a face end 26, which is diametrically opposite a face end 28 of the injection valve member 12 embodied in particular in needle-like form. The valve piston 24 is surrounded by a coupler sleeve 30.

By means of the coupler, which includes both the valve piston 24 and the coupler sleeve 30 surrounding it, the reciprocating motion of an actuator, such as an electromagnet or a piezoelectric actuator, is transmitted to the injection valve member 12 that is embodied in particular in needle-like form.

The coupler sleeve 30 includes a first face end 32 an a second face end 34. A bite edge 36 is embodied on the second face end 34 of the coupler sleeve 30. With the bite edge 36, the coupler sleeve 30 is positioned against the face end 20 of the nozzle body 18. The coupler sleeve 30 is subjected to a prestressing force via a prestressing element not shown in FIG. 1. From the illustration in FIG. 1, it can be seen that the valve piston 24, which is a component of the hydraulic coupler, includes a constriction 38.

The fuel injector 10 shown in FIG. 1 has a diameter difference between the inside diameter of the coupler sleeve 30 and the outside diameter of the injection valve member that is on the order of magnitude of 0.3 mm. This guidance play leads to a trailing of the coupler pressure compared to the system pressure $P_{sys}$ by approximately 100 μs. Because of the guidance play that is due to the diameter difference on the order of magnitude of 0.3 mm, a quantity of fuel trails after during the reciprocating motion of the valve piston 24. Since the coupler sleeve 30 lifts from the end face 20 of the nozzle body 18 after each injection, the coupler sleeve 30 after each injection finds a slightly different position, whereupon the shape of the guide gap varies from one injection event to another. The trailing fuel quantity flowing into the coupler volume affects the closing motion and the closing instant of the injection valve member 12 that is preferably embodied in needle-like form, and this leads to variations from stroke to stroke that are markedly greater in comparison to conventional injectors. In these conventional fuel injectors that are subject to leakage, the valve piston is surrounded by fuel that is at return flow pressure (low pressure). As a result, continuous leakage from the control chamber occurs along the valve piston guide on the one hand and from the high-pressure chamber along the injection valve member along the guidance of the injection valve member into the volume surrounding the valve piston.

Unlike this situation, in leak-free injectors, the volume surrounding the valve piston is connected to the high-pressure region. As a result, the leakage for lack of a pressure gradient at the guides of the components movable relative to one another is suppressed.

Figure 2:
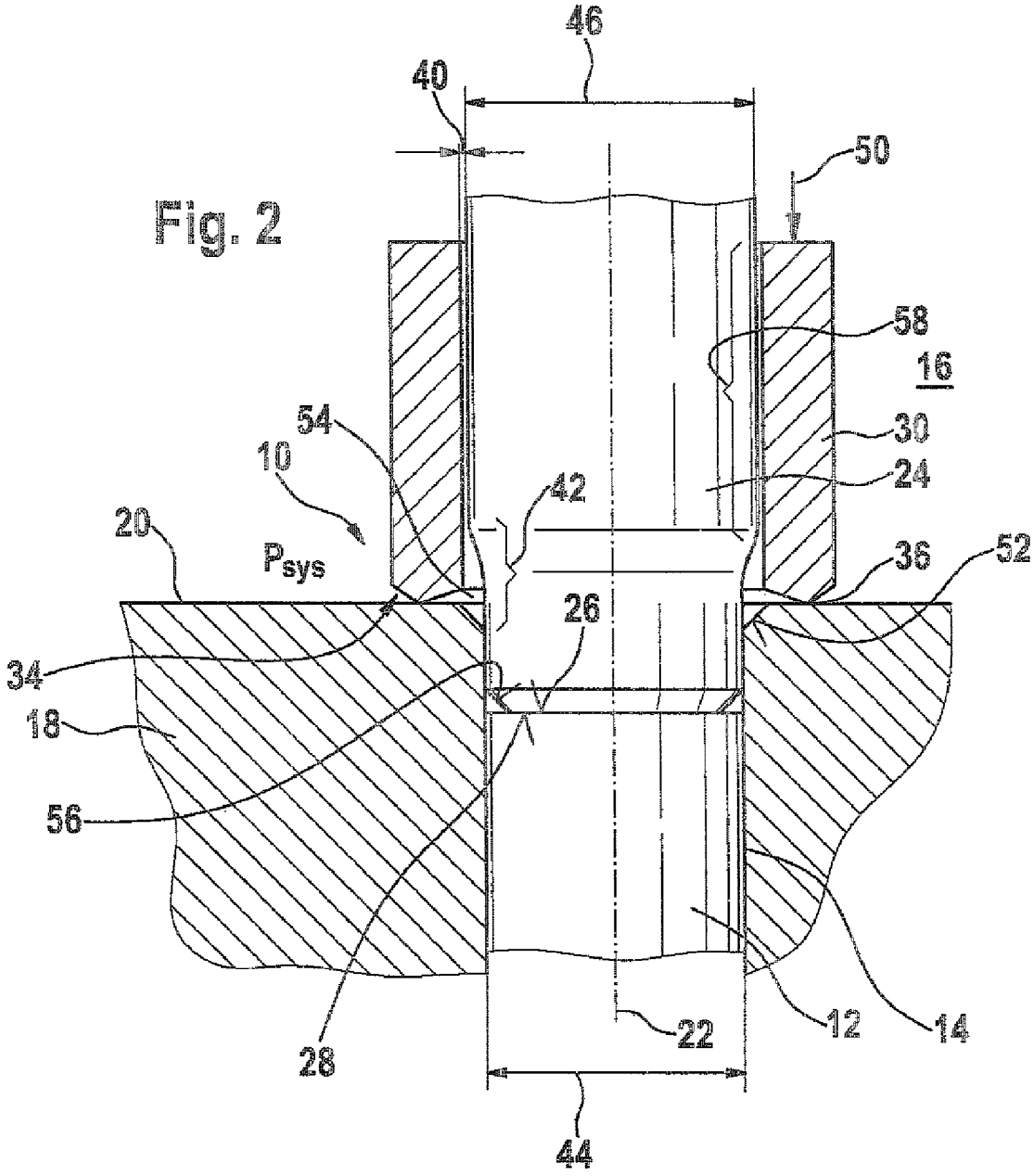
FIG. 2 shows the embodiment proposed according to the invention of a hydraulic coupling between a valve piston of a coupler and an injection valve member that in particular is embodied in needle-like form.

FIG. 2 shows a section through a coupler proposed according to the invention. From FIG. 2 it can be seen that the fuel injector 10 includes the injection valve member 12 embodied in needle-like form, which is guided in the bore 14 of the nozzle body 18. In the hollow chamber 16 of the fuel injector 10, system pressure $P_{sys}$ prevails. The coupler sleeve 30 is positioned against the face end 20 of the nozzle body 18. The first face end of the coupler sleeve is identified by reference numeral 32 (FIG. 1) and its second face end is identified by reference numeral 34. Unlike the coupler sleeve 30 shown in FIG. 1, the coupler sleeve 30 used with the fuel injector 10 proposed according to the invention has a substantially rectangular cross section. The axis of the injection valve member 12 that is preferably embodied in needle-like form is identified by reference numeral 22. The bite edge 36 is located on the second face end 34 of the coupler sleeve 30, which has a substantially rectangular cross section. The coupler sleeve 30 is positioned against the face end 20 of the nozzle body because of the action of a positioning force 50. From FIG. 2 it can furthermore be seen that a guidance play 40 between the inside diameter 46 of the coupler sleeve 30 and the outside diameter of the valve piston 24 is ≦5 μm. In the region, that is, its guidance length 58, in which the valve piston is guided in the coupler sleeve 30, the valve piston 24 has the diameter 46, taking into account the guidance play 40 of ≦5 μm relative to the coupler sleeve 30. A transitional region 42 is indicated on the valve piston 24 of the coupling; inside it, the diameter of the valve piston 24 changes over to a diameter that is equivalent to the diameter of the bore 14 embodied in the nozzle body 18 and that is essentially equivalent to the outside diameter 44 of the injection valve member 12. From FIG. 2, it can be seen that in the stage of the reciprocation phase shown of the injection valve member 12, preferably embodied in needle-like form, and of the valve piston 24 of the coupler, the face end 26 of the valve piston 24 rests on a face end 28 of the injection valve member 12 that is preferably embodied in needle-like form.

Between the coupler sleeve 30, the outer circumference of the valve piston 24, and the face end 20 of the nozzle body 18, a coupler chamber 54 is embodied, which has a coupler volume that is on the order of magnitude of ≦40 $mm^3$. At a minimal guidance play 40 of ≦5 μm between the inside diameter 46 of the coupler sleeve 30 and the outside diameter of the valve piston 24, a negligible quantity of fuel at system pressure $P_{sys}$ trails after, past the hollow chamber 16, in which system pressure $P_{sys}$ prevails, into the coupler chamber 54. Since the trailing volumetric flow into the coupler chamber 54 is proportional to the pressure difference via the guidance length 58, but inversely proportional to the third power of the guidance play 40, the reduction in the guidance play 40 to values below 5 μm is extremely effective for reducing the trailing volumetric flow. The bore 14, in which part of the valve piston 24 of the coupler as well as the injection valve member 12, preferably embodied in needle-like form, are guided in the nozzle body 18, has a chamfer 52 at the face end 20. A chamfer 56 may likewise be embodied on the face end 26 of the valve piston 24 of the coupler. Preferably, the face ends 26 and 28 of the valve piston 24 and of the injection valve member 12, preferably embodied in needle-like form, respectively, are embodied in plane form. On the one hand, the fuel injector 10 shown in FIG. 2 on the one hand has a diameter difference of between 0.2 mm and 0 mm between the inside diameter 46 of the coupler sleeve 30 and the outside diameter 44 of the injection valve member 12 preferably embodied in needle-like form. Because of this slight remaining difference in diameter, the pressure drop inside the coupler during the reciprocating motion of the injection valve member 12, preferably embodied in needle-like form, is reduced. If the difference in diameter between the inside diameter 46 of the coupler sleeve 30 and the outside diameter 44 of the injection valve member 12, preferably embodied in needle-like form, is 0 mm, then a pressure difference ΔP now occurs only during the lifting of the injection valve member 12, preferably embodied in needle-like form, from its seat, and this pressure difference disappears again as soon as the injection valve member, preferably embodied in needle-like form, has left the seat throttle restriction region. The guidance play 40 between the coupler sleeve 30 and the valve piston 24 is reduced to values of ≦5 μm, so that the trailing volumetric flow into the coupler chamber 54 via the reduced guidance play 40 is effectively reduced. Moreover—as shown in FIG. 2—the guidance length 58, inside which the valve piston 24 of the coupler is guided in the coupler sleeve 30, is lengthened considerably, compared to the guidance length shown in FIG. 1. To attain as delay-free trailing as possible of the injection valve member 12, preferably embodied in needle-like form, relative to the valve piston 24, the fuel volume inside the coupler sleeve 30 is limited in the closed state of the fuel injector to values of ≦40 $mm^3$.

The foregoing relates to the preferred exemplary embodiment of the invention, it being understood that other variants and embodiments thereof are possible within the spirit and scope of the invention, the latter being defined by the appended claims.

The invention claimed is:

1. A fuel injector with a coupler for transmitting a reciprocating motion of an actuator to an injection valve member that is embodied in particular in needle-like form and is guided in a nozzle body, and the coupler having a valve piston and a coupler sleeve, and the injection valve member having an outside diameter, and the coupler sleeve having an inside diameter, the valve piston being guided in the inside diameter of the coupler sleeve, wherein the inside diameter of the coupler sleeve is greater than the outside diameter of the injection valve member by at most a difference of 0.2 mm wherein on the valve piston of the coupler, a transitional region is embodied, inside which the diameter of the valve piston changes over to a diameter that is equivalent to the diameter of a bore, which is embodied in the nozzle body and in which the injection valve member is guided with its outside diameter.

2. The fuel injector as defined by claim 1, wherein between the valve piston, the coupler sleeve, and the injection valve member, a coupler chamber is embodied and a coupler volume of the coupler chamber is at most 40 $mm^3$.

3. The fuel injector as defined by claim 2, wherein a guidance play between the coupler sleeve and the valve piston is at most 5 μm.

4. The fuel injector as defined by claim 3, wherein a guidance length, within which the valve piston and the coupler sleeve are guided, is at least 5 mm.

5. The fuel injector as defined by claim 4, wherein the nozzle body has a chamfer in a region of one face end of the nozzle body at a bore of the nozzle body.

6. The fuel injector as defined by claim 5, wherein the coupler sleeve is positioned against a face end of the nozzle body by a prestressing force.

7. The fuel injector as defined by claim 6, wherein the coupler sleeve has a bite edge.

8. The fuel injector as defined by claim 2, wherein a guidance length, within which the valve piston and the coupler sleeve are guided, is at least 5 mm.

9. The fuel injector as defined by claim 2, wherein the nozzle body has a chamfer in a region of one face end of the nozzle body at a bore of the nozzle body.

10. The fuel injector as defined by claim 2, wherein the coupler sleeve is positioned against a face end of the nozzle body by a prestressing force.

11. The fuel injector as defined by claim 1, wherein a guidance play between the coupler sleeve and the valve piston is at most 5 μm.

12. The fuel injector as defined by claim 1, wherein a guidance length, within which the valve piston and the coupler sleeve are guided, is at least 5 mm.

13. The fuel injector as defined by claim 1, wherein the nozzle body has a chamfer in a region of one face end of the nozzle body at a bore of the nozzle body.

14. The fuel injector as defined by claim 1, wherein the coupler sleeve is positioned against a face end of the nozzle body by a prestressing force.

15. The fuel injector as defined by claim 1, wherein the coupler sleeve has a bite edge.

16. The fuel injector as defined by claim 1, wherein the valve piston has a chamfer on its face end oriented toward the injection valve member.

17. The fuel injector as defined by claim 1, wherein the coupler sleeve, parallel to its axis of symmetry, has a substantially rectangular cross section.

* * * * *